United States Patent [19]

Johansson

[11] Patent Number: 4,542,702

[45] Date of Patent: Sep. 24, 1985

[54] JOINT ELEMENT TO SUPPORT AND SECURE SHELVES IN A BOOKCASE OR STAND, AND A SET OF SHELVES EMPLOYING SAID JOINT ELEMENTS TO SUPPORT AND SECURE THE SHELVES BETWEEN THE UPRIGHTS

[76] Inventor: Evert Martin Johansson, Karlberg, Tölö , S-15400 Gnesta, Sweden

[21] Appl. No.: 477,412

[22] Filed: Mar. 21, 1983

[30] Foreign Application Priority Data

Apr. 13, 1982 [SE] Sweden ..... 8202305

[51] Int. Cl.[4] ..... A47B 9/00

[52] U.S. Cl. ..... 108/109; 248/249

[58] Field of Search ..... 108/109; 248/249

[56] References Cited

U.S. PATENT DOCUMENTS

| | | | |
|---|---|---|---|
| 566,305 | 8/1896 | Geuder | 108/109 |
| 754,816 | 3/1904 | Schriefer | 108/109 |
| 3,039,619 | 6/1962 | Lyon | 108/109 |
| 3,608,504 | 9/1971 | Peters | 108/109 |
| 4,201,139 | 5/1980 | Suttles | 108/109 |

FOREIGN PATENT DOCUMENTS

| | | | |
|---|---|---|---|
| 2334393 | 1/1975 | Fed. Rep. of Germany | 108/109 |
| 28024 | 4/1956 | Finland | 108/109 |
| 1229258 | 3/1960 | France | 108/109 |
| 142394 | 10/1953 | Sweden . | |
| 348927 | 9/1972 | Sweden . | |

*Primary Examiner*—Francis K. Zugel

*Attorney, Agent, or Firm*—Ostrolenk, Faber, Gerb & Soffen

[57] ABSTRACT

The invention relates to joint elements to support and secure shelves in bookcases or stands, and to a set of shelves employing said joint elements to secure the shelves in the uprights, comprising a first insertion part (1) designed to be inserted into a recess (10) directly obliquely downwards in the surface of the uprights (7, 8) and a bent section (2) connected to the insertion part (1), said bent section comprising a supporting portion (3) at the joining point between shelf and upright, directed substantially at right angles to the surface of the uprights and intended to support the shelf (6), and also a second insertion part (4), directed upwardly substantially at right angles to the supporting portion (3) and intended to be inserted in a recess (9) arranged substantially perpendicularly in the lower surface of the shelf.

7 Claims, 4 Drawing Figures

FIG.1
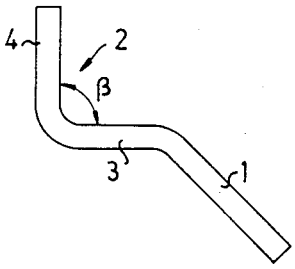
FIG. 2
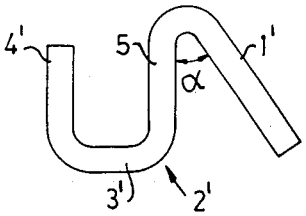
FIG. 3
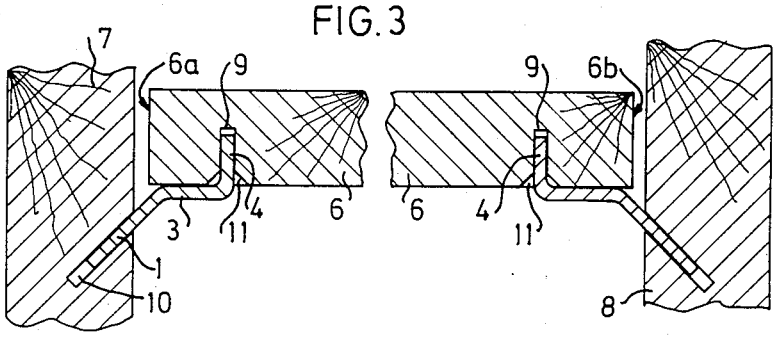
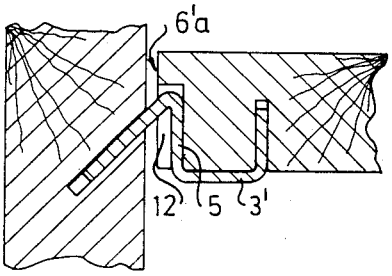
FIG.4

JOINT ELEMENT TO SUPPORT AND SECURE SHELVES IN A BOOKCASE OR STAND, AND A SET OF SHELVES EMPLOYING SAID JOINT ELEMENTS TO SUPPORT AND SECURE THE SHELVES BETWEEN THE UPRIGHTS

BACKGROUND OF THE INVENTION

The present invention relates to a joint element to support and secure shelves in bookcases or stands and to a set of shelves employing said joint elements to support and secure the shelves in the uprights.

There are many different systems for achieving shelf support between the uprights of the bookcase or stand. In almost all these known systems the shelves are loosely supported by various support means arranged at the ends of the shelves. The known systems are complicated to a greater or lesser degree and often require relatively expensive machining of the ends and surface of the shelves and/or the attachment of various support brackets or fittings to the shelves or the uprights.

The object of the present invention is to achieve a joint element for supporting and securing shelves in bookcases or stands, which joint element is extremely inexpensive to manufacture and requires minimal machining of shelves and uprights, without neglecting the strength and reliability of the joint between them.

Another object of the present invention is to achieve a shelf system which is extremely easy to assemble and dismantle.

Yet another object of the present invention is to achieve a shelf system providing a strong joint between shelves and uprights at increased loading of the shelves.

Another object of the present invention is to achieve a shelf system permitting arbitrary location of horizontal and/or inclined shelves between the uprights.

SUMMARY OF THE INVENTION

The above objects are achieved according to the present invention in that the joint element and set of shelves are given the features defined in the claims.

Providing the joint element with a first insertion part intended to be inserted in a recess arranged obliquely downwardly in the surface of the upright, said recess preferably consisting of a partially drilled hole with circular cross-section with a depth exceeding the length of the insertion part, ensures reliable retention of the joint element in the upright when assembling the set of shelves. Providing a bent section connected to the insertion part, said bent section comprising a supporting portion at the joining point between shelf and upright, directed substantially at right angles to the surface of the upright and intended to support the shelf, ensures the supporting capacity of the joint element in an extremely simple manner. To ensure that the shelves are secured to the uprights, the uprights simultaneously pressing against the ends of the shelves, a second insertion part is arranged extending substantially at right angles to the supporting portion and into a recess arranged substantially perpendicularly in the lower surface of the shelf.

In a first embodiment the bent section of the joint element is substantially L-shaped, the first insertion part being connected directly to the lower leg end of the L. This embodiment of the joint between requires only the arrangement of partially drilled holes in the uprights and in the under surface of the shelf. These holes can be made with conventional drilling equipment if the joint element consists of a piece of bent wire with circular cross-section, which is the preferred embodiment of the joint element.

The bent section of the joint element may also be U-shaped. However, this embodiment requires a recess along the end surface of the shelf to receive the leg of the bent section connection to the first insertion part. This embodiment is preferable if the shelf is to be able to carry maximum load since any tendency towards deformation of the upright in conjunction with its recess is to a great extent eliminated by the presence of the end of the shelf which will exert a counter force to such deformation.

Another advantage of the joint element with U-shaped bent section is that it enables the shelves to be inclined between the uprights. In this case, however, the perpendicular holes in the under surface of the shelf shall be displaced slightly backwards to permit inclination of the shelf. It is then expedient to arrange two holes in the under surface of the shelf, permitting optional horizontal or inclined placing of the shelves between the uprights.

Inclined placing of the shelves is also possible when using joint elements with L-shaped bent sections, in which case the inclination can be increased by giving the partially drilled hole in the uprights greater diameter than the diameters of the first and second insertion parts.

By inclining the recesses in the uprights downwardly—for receipt of the first insertion parts of the joint elements—and by adjusting the distance between the shelf ends and the recesses in the lower side of the shelf so that the insertion parts of the joint elements are located slightly inside the shelf ends, the effect is achieved that when the shelf is loaded, the uprights will be pressed towards the shelf ends.

The uprights being thus drawn together when the shelves are loaded contributes to the stability of the set of shelves, thus reducing the need for a piece covering the rear of the set of shelves. Such a rear piece may possibly be replaced by relatively weak strips or wires arranged diagonally at the rear of the set of shelves. In the case of an open bookcase, i.e. one without any rear piece, it may even be unnecessary to stay the rear when the shelves are fully loaded.

To facilitate assembly of the set of shelves, the openings of the recesses on the lower side of the shelves are preferably bevelled. The recesses can thus be felt more easily with the fingers and can therefore more easily be manuevered into the correct position to cooperate with the second insertion part of the joint element during assembly. Bevelling also enables the free ends of the second insertion parts to pass more easily into the recesses, said recesses preferably comprising partially drilled holes with cylindrical cross-section.

BRIEF DESCRIPTION OF THE DRAWINGS

The invention will now be described with reference to a couple of embodiments shown in the accompanying drawings in which:

FIG. 1 shows a side view of a first embodiment of the joint element according to the invention, FIG. 2 shows a side view of a second embodiment of the joint element according to the invention, FIG. 3 shows a longitudinal section through shelf, joint elements and uprights, using the joint element according to FIG. 1, and where FIG. 4 shows a longitudinal section through shelf, joint elements and uprights, using the joint element according to FIG. 2.

DETAILED DESCRIPTION OF THE DRAWINGS

FIG. 1 shows a first embodiment of the joint element comprising an insertion part 1, a bent section—generally designated 2—said bent section comprising a supporting portion 3 and a second insertion part 4.

An alternative embodiment of the joint element according to the invention shown in FIG. 2 also shows a first insertion part 1', a bent section—generally designated 2'—said bent section, besides the supporting portion 3' and the second insertion part 4', also having a leg portion 5 connecting the first insertion part 1' to the supporting portion 3'.

FIG. 3 shows the joint element according to FIG. 1 during assembly of the shelf 6 between two uprights 7 and 8. A circular hole 9 is provided in the shelf to receive the insertion part 4, and a hole 10 is provided in the upright 7 to receive the first insertion part 1 of the joint element. If the joint element consists of a bent wire, i.e. a body with circular cross-section, which is to be preferred, the opening of the hole 9 may be bevelled 11 for the reasons mentioned above.

FIG. 3 shows the shelf 6 during assembly between uprights 7 and 8, i.e. the shelf 6 has not yet assumed its final position between the uprights. To obtain greatest stability in the finished set of shelves according to the invention, it is desirable for the shelf 6 to be loaded in order to draw together the uprights 7 and 8. This is achieved by further lowering the shelf—from the position shown in FIG. 3–in relation to the uprights 7 and 8, so that the first insertion parts 1 of the joint elements will provide this compressing action. This effect will be maximal if the shelf ends 6*a* and 6*b* protrude slightly over the first insertion part 1 of each joint element.

The pressure between the shelf 6 and uprights 7 and 8 may be utilized, if desired, to provide permanent securing of the shelves to the uprights. This pressure, achieved by loading the assembly shelf, for instance, is used when glueing the shelves to the uprights.

FIG. 4 shows the second embodiment of the joint element during assembly to one upright. As opposed to the embodiment described and shown in conjunction with FIGS. 1 and 3, the shelf end 6'*a* is provided with a notch 12 to take up the leg part 5 of the bent section 2'. In other respects the same applies as described in conjunction with the embodiment shown in FIG. 3.

Concerning the possibility of inclining the shelf 6 between the uprights 7 and 8, it may be noted that the embodiment shown in FIG. 3 permits an inclination of ca 30° without special steps having to be taken with respect to joint element or holes drilled in shelf or uprights. The angle of inclination can be increased to a certain extent, however, if the diameter of the hole in the upright is made somewhat larger than the one of the insertion part 1. It should be mentioned here that the uprights are preferably provided with a set of drilled holes running in two rows along the sides of the uprights, the joint elements to be used to support the rear part of the shelves are inserted in holes located higher than the holes into which the joint elements for the front part of the shelves are inserted.

It should be mentioned that special drill holes are required in the lower sides of the shelves to enable inclination of the shelves when using the joint elements according to FIG. 2. An increased angle of inclination when using joint elements according to FIG. 2 can be achieved by increasing the angle between insertion part 1' and the leg part 5 somewhat, depending on the desired angle of inclination. This joint element can then only be used for inclined shelves.

It should be mentioned in this connection that the angle $\beta$ between the supporting portion 3 and the second insertion part 4 can be increased somewhat for the reasons stated above concerning inclined shelves, but this is not normally necessary.

The first insertion parts 1 and 1', respectively, and the second insertion part 4 may be bevelled at their points in order to facilitate insertion into the holes therefor and, most important, to eliminate the risk of pieces being chipped out of the uprights, which are often surface-treated, during insertion.

The invention is in no way limited to the embodiments described above. Modifications are feasible within the scope of the following claims.

I claim:

1. A shelf assembly comprising:

two vertically disposed, spaced apart uprights having respective opposed facing faces; a respective recess defined in each of the faces for being opposite a recess in the other face, whereby the two recesses are paired to cooperate, each of said recesses in said uprights having an opening at said face and each said recess extending obliquely downward into the respective upright away from the other upright;

a shelf disposed between the uprights, the shelf having a lower surface; the shelf having opposite ends at the uprights; a respective recess into the lower surface of the shelf spaced inward from each of the ends, and extending upward into the shelf and being accessible through the lower surface; and a respective joint element for each end of the shelf for joining the shelf to both uprights, each joint element comprising a wire bent in one plane to form a bent section including a first upstanding inserting part for insertion from below into the respective recess in the shelf; the bent section also including a supporting section which extends from the first inserting part along the lower surface of the shelf toward the upright, the bent section having an end slightly inward from the shelf end at that upright, and a second inserting part which extends obliquely downward from the end of the bent section, the second inserting part of each respective joint element being receivable in the respective oblique recess of the respective upright, each second inserting part thereby extending obliquely to a point slightly inward from the shelf end at the respective upright to the end of the bent section so that said joint elements pull the uprights together and toward the ends of the shelf when the shelf is loaded.

2. Joint element according to claim 1 wherein the bent section is generally L-shaped.

3. Joint element according to claim 1, wherein the bent section is generally U-shaped.

4. Joint element according to claim 3 wherein the diameter of the wire is less than the diameter of the recess in the uprights or in the shelf.

5. A shelf assembly according to claim 1 wherein at least one of the shelves is arranged at an angle between the uprights.

6. A shelf assembly according to claim 1, wherein the bent section of the joint element is generally U-shaped including one leg which defines the first insertion part, a second leg at and meeting the second insertion part, and a web joining the first and second insertion parts and also serving as the supporting section; the shelf including an additional recess at the respective end of the shelf for receiving the second leg of the joint element.

7. A shelf assembly according to claim 1, wherein each respective recess at the lower surface of the shelf is bevelled for insertion of the respective first inserting part into the recess.

* * * * *